US008561539B2

(12) United States Patent
Schultze et al.

(10) Patent No.: US 8,561,539 B2
(45) Date of Patent: Oct. 22, 2013

(54) METHOD FOR REGULATING A WEB TENSION AND/OR REGISTER

(75) Inventors: Stephan Schultze, Lohr (DE); Holger Schnabel, Rottendorf (DE)

(73) Assignee: Robert Bosch GmbH, Stuttgart (DE)

( * ) Notice: Subject to any disclaimer, the term of this patent is extended or adjusted under 35 U.S.C. 154(b) by 685 days.

(21) Appl. No.: 12/339,188

(22) Filed: Dec. 19, 2008

(65) Prior Publication Data

US 2009/0162126 A1 Jun. 25, 2009

(30) Foreign Application Priority Data

Dec. 22, 2007 (DE) ..... 10 2007 062 454

(51) Int. Cl.
*B41L 35/14* (2006.01)

(52) U.S. Cl.
USPC ..... 101/488; 101/485

(58) Field of Classification Search
USPC ..... 101/488
See application file for complete search history.

(56) References Cited

U.S. PATENT DOCUMENTS

| | | | | |
|---|---|---|---|---|
| 4,147,104 | A | 4/1979 | Zernov | |
| 4,497,027 | A * | 1/1985 | McGuire et al. | 700/127 |
| 4,798,136 | A * | 1/1989 | Tittgemeyer et al. | 101/181 |
| 5,389,204 | A * | 2/1995 | Ampulski | 162/135 |
| 5,485,386 | A * | 1/1996 | Andreasson | 700/117 |
| 5,813,337 | A * | 9/1998 | Peters et al. | 101/228 |
| 5,927,196 | A * | 7/1999 | Murray | 101/219 |
| 6,053,107 | A * | 4/2000 | Hertel et al. | 101/490 |
| 6,063,107 | A * | 5/2000 | Wexler | 606/234 |
| 6,106,177 | A * | 8/2000 | Siegl et al. | 400/618 |
| 6,211,968 | B1 | 4/2001 | Gloeckner et al. | |
| 6,423,184 | B2 * | 7/2002 | Vahatalo et al. | 162/198 |
| 6,430,972 | B1 * | 8/2002 | Motzke | 68/205 R |
| 6,598,529 | B2 * | 7/2003 | Muller | 101/484 |
| 7,040,231 | B2 * | 5/2006 | Schaede | 101/484 |
| 7,421,948 | B2 * | 9/2008 | Schneider et al. | 101/487 |
| 7,464,645 | B2 * | 12/2008 | Jeschonneck et al. | 101/484 |
| 7,536,955 | B2 * | 5/2009 | Bernard et al. | 101/484 |
| 2003/0089248 | A1 * | 5/2003 | Linnonmaa et al. | 100/161 |
| 2004/0173149 | A1 * | 9/2004 | De Vroome | 118/694 |
| 2004/0231542 | A1 | 11/2004 | Seyfried | |

FOREIGN PATENT DOCUMENTS

| | | |
|---|---|---|
| DE | 195 25 170 | 1/1997 |
| DE | 199 18 399 | 11/1999 |
| DE | 101 35 773 | 2/2003 |
| DE | 102 04 484 | 8/2003 |
| DE | 103 22 098 | 12/2004 |
| DE | 103 45 593 | 7/2005 |
| WO | 92/10419 | 6/1992 |

* cited by examiner

*Primary Examiner* — Anthony Nguyen
(74) *Attorney, Agent, or Firm* — Michael J. Striker

(57) ABSTRACT

In a method for regulating a web tension and/or a register of a processing machine used to process a material web (101), in particular a shaftless printing press (100), the material web (101) is processed in at least one processing unit (111-114, 121-124, 131-134); the elasticity module of the material of the material web (101) is changed by moisture entering the material, and/or by moisture leaving the material, a quantity that represents the addition of moisture to the material and/or the loss of moisture from the material being taken into account in the regulation.

8 Claims, 2 Drawing Sheets

METHOD FOR REGULATING A WEB TENSION AND/OR REGISTER

CROSS-REFERENCE

The invention described and claimed hereinbelow is also described in DE 10 2007 062 454.0, filed on Dec. 22, 2007. This German Patent Application, whose subject matter is incorporated here by reference, provides the basis for a claim of priority of invention under 35 U.S.C. 119 (a)-(d).

BACKGROUND OF THE INVENTION

The present invention relates to a method for controlling a web tension and/or a register, and to a related computer program and a related computer program product.

Although the text below refers mainly to printing presses, the present invention is not limited thereto, but rather is directed to all types of processing machines with which a continuous material and/or a material web is processed. The present invention may be used, in particular, with printing presses such as newspaper presses, jobbing presses, gravure presses, printing presses for packaging or currency, and processing machines such as bagging machines, envelope machines, or packaging machines. The material web may be paper, cardboard, plastic, metal, rubber, or foil, etc.

BACKGROUND INFORMATION

In processing machines, in particular printing presses, a material web is moved along by driven axles (web conveyance axles), such as tension rollers or feed rollers, and by non-driven axles, such as breaker rollers, guide rollers, drying rollers, or cooling rollers. The material web is simultaneously processed, e.g., it is printed on, punched, cut, folded, etc., using processing axles, which are usually also driven. The processing of the material web often causes the physical properties of the material web to change, which often results in the time constants of the controller being changed.

In processing machines that are designed as printing presses, the material web is printed on in printing units, and it is dried in downstream drying units. In this process, water, or fluid or moisture in general, is generally added to the material web via the ink to be applied, thereby changing the stretch behavior of the material web, i.e., the stretch behavior typically becomes "softer". In the downstream drying units, this change is undone, either entirely or partially, via the drying that takes place, i.e., the stretch behavior typically becomes "harder". The drying units are typically followed by cooling units, e.g., cooling rollers, which are used to cool the heated material web. Processing-time constants, which are dependent on the stretch behavior or the elasticity module of the material comprising the material web, are therefore changed continually during processing. The related controllers therefore become parametrized incorrectly and must be adjusted softly or slowly accordingly, and in a manner that is tolerant to these changes.

The object, therefore, is to provide an improved method for regulating a web tension and/or a register, in the case of which the disadvantages described above must be overcome to the greatest extent possible.

In the method according to the present invention, a web tension and/or a register of a processing machine that is used to process a material web is regulated. The material web is processed in at least one processing device. The elasticity module of the material comprising the material web is changed by moisture entering the material comprising the material web, and/or by moisture leaving the material comprising the material web, in particular in the at least one processing device. According to the present invention, a quantity that represents the addition of moisture to the material comprising the material web, and/or the removal of moisture from the material comprising the material web is taken into account in the regulation.

The present invention is suited for use in particular with a shaftless printing press. A color register or a longitudinal register, for example, is suited for use as a register controlled variable. The assigned quantity may be determined, in particular, or it may be known in advance, e.g., from machine data. It may be, in particular, a heat output or temperature of a drying unit, a cooling output or temperature of a cooling unit, a drying time or throughput time of the material web through the drying or cooling unit, or, generally, through regions of the processing machine. In particular, it should be pointed out here that drying or cooling of the material web also takes place outside of drying and cooling units, and that this removal of moisture preferably also be taken into account.

SUMMARY OF THE INVENTION

The disadvantages of the prior art are overcome via the solution according to the present invention. In particular, the controller design, the controller settings, and pilot control values may be adapted to the influencing variables that are the addition and removal of moisture. It is now advantageously possible to influence and change time constants that influence the process behavior, e.g., of a web tension or a longitudinal register, and to adjust the related controller in an optimal manner. It is not necessary to determine the elasticity module in a complicated manner, since it or its changes may be derived from the assigned variable.

Advantageously, the assigned variable is taken into account as the control parameter, input quantity, and/or pilot control (or "feed-forward") value of the actual and/or setpoint values. It is also advantageous that a material characteristic value of the material comprising the material web is taken into account.

If the processing machine is designed as a printing press, then, e.g., a change to the elasticity module or the stretch behavior of a material web may be derived from an effective addition of moisture, e.g., via a printing process, and/or from an effective removal of moisture, e.g., via a drying process. A quantity of ink and/or water, or a quantity of fluid in general, that will be applied by a printing unit may be used as the quantity to be assigned to represent the addition of moisture to the material comprising the material web. A heat output, radiation output (e.g., UV dryer), and/or temperature of a drying unit, a drying time, e.g., in a drying unit or in the air, a cooling output and/or temperature of a cooling unit, e.g., a cooling roller temperature, a cooling time, e.g., when wrapping around a cooling roller or in the air, may be used as the variable that represents the removal of moisture from the material comprising the material web. The drying or cooling time may be determined easily from the conveyance speed and the distance to be traversed. Advantageously, it is therefore not necessary to determine absolute values of the elasticity module.

It is also advantageous to standardize the values for the addition of moisture and/or removal of moisture by using related material characteristic values, or, as an alternative, to provide the material characteristic value as an additional input variable for the regulation, since changes in moisture typically affect various materials differently. For example, the behavior of foil, as the material to be printed on, is typically influenced more than paper by drying or temperature, and it is influenced less than paper by the addition of moisture.

It is advantageous when at least one pilot control value is determined based on a measurement run, in particular by considering the web tension and/or register in terms of regulation. It is also advantageous that at least one pilot control value is adapted to the process, continually in particular. Expediently, the processing machine includes at least one damping unit and/or drying unit, the adaption being carried out based on setpoint quantities and/or actual quantities of the at least one damping unit and/or drying unit. A quantity of fluid (ink quantity, water quantity, etc.), drying unit output, drying unit setpoint temperature and/or drying unit actual temperature, cooling unit output, cooling roller setpoint temperature and/or cooling roller actual temperature are suitable for use in particular as the setpoint and/or actual quantities. It is advantageous to also calculate a model of the physical details of the material characteristic values as a function of the adaptation quantities.

Expediently, the processing machine is designed as a printing press, and at least one pilot control value and/or at least one initialization value for the adaptation are/is obtained from prepress data.

In a processing machine, the addition of moisture in the damping unit and the removal of moisture are typically controlled by the machine control, e.g., via a dryer temperature/output. It is therefore easy to determine pilot control values based on control quantities, such as the dryer setpoint temperature, dryer actual temperature, dryer output, cooling roller setpoint temperature, etc. As an alternative, the expected drying or moistening may be obtained from prepress data. It is possible to obtain from these prepress data at least one initialization value for the dynamic adaptation and/or at least one static value that is not subject to adaptation. It is also possible, as an option, to take the system behavior into account, in particular most of the relatively large time constants, the drying unit-material web path, and the damping unit-material web path.

The controller may utilize a control strategy that is based on fuzzy logic. This is typically referred to as fuzzy logic.

It is also advantageous to provide automatic controller adjustment that is based on the overall system behavior that is observed, i.e., the behavior with precontrol. This is often referred to as autotuning.

A processing machine according to the present invention includes, in particular, all means for carrying out a method according to the present invention.

The present invention also relates to a computer program comprising program code means for implementing all steps of a method according to the present invention when the computer program is run on a computer or a related arithmetic unit, in particular in a processing machine.

The computer program product—which is provided according to the present invention—comprising program code means, which are stored on a computer-readable data storage device, is designed to carry out all steps of a method when the computer program is run on a computer or a related arithmetic unit, in particular in a processing machine. Suitable data storage devices are, in particular, diskettes, hard drives, Flash drives, EEPROMs, CD-ROMs, DVDs, etc. It is also possible for a program to be downloaded from computer networks (Internet, intranet, etc.).

Further advantages and embodiments of the present invention result from the description and the attached drawing.

It is understood that the features mentioned above and to be described below may be used not only in the combination described, but also in other combinations or alone, without leaving the scope of the present invention.

The present invention is depicted schematically with reference to an embodiment in the drawing, and it is described in detail below with reference to the drawing.

DETAILED DESCRIPTION OF THE PREFERRED EMBODIMENTS

Figure 1:
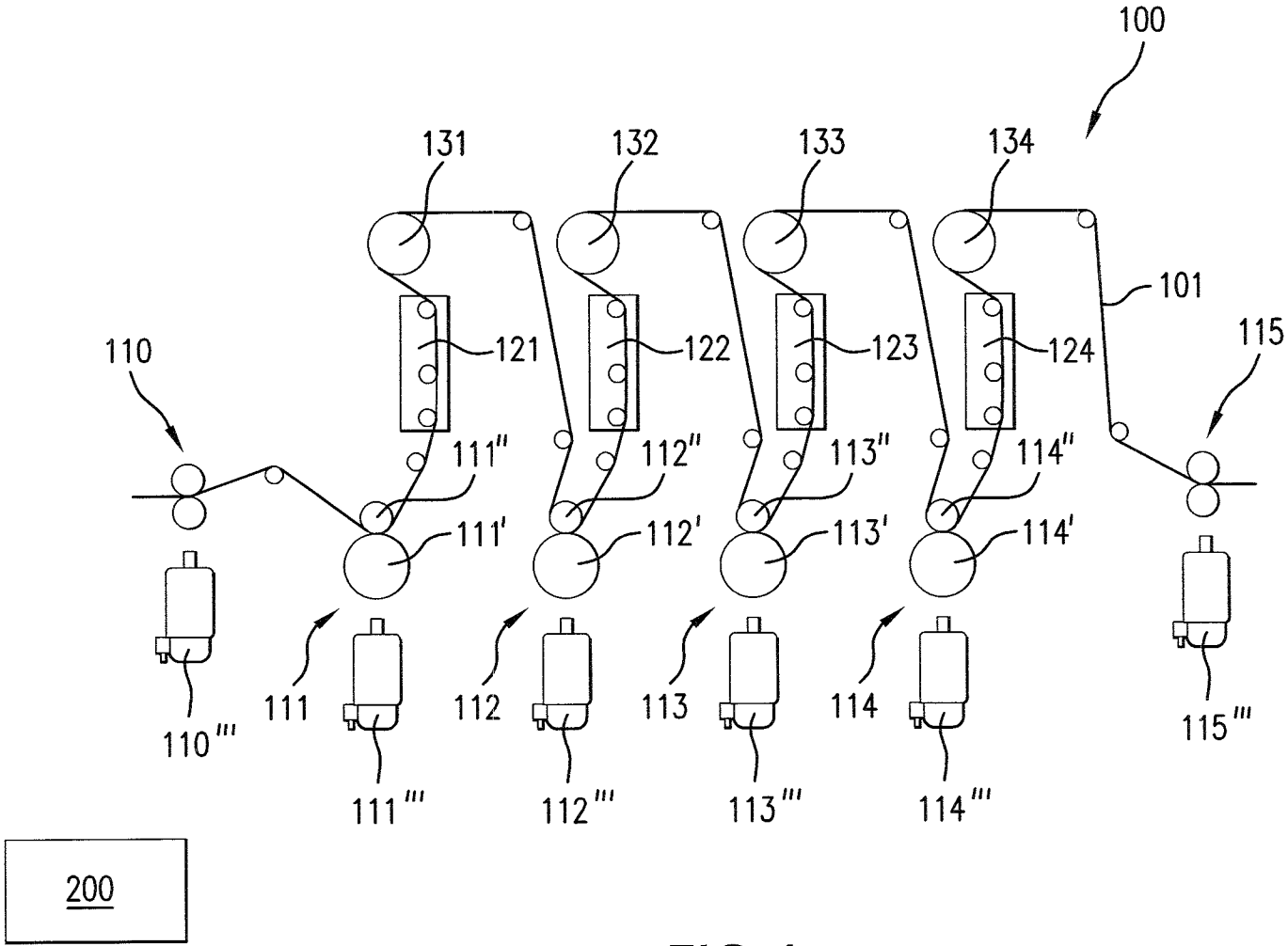
FIG. 1 is a schematic depiction of a preferred embodiment of a processing machine that is designed as a printing press.

A preferred embodiment of a processing machine that is designed as a printing press is labelled as a whole with reference numeral 100 in FIG. 1. A material to be printed on, e.g., paper 101, is supplied to the machine via an infeed 110. Paper 101 is then guided through a processing device that is designed as printing units (damping units) 111, 112, 113, 114, and they are printed on, then output via an outfeed 115. Infeed, outfeed, and printing units 110 through 115 are located such that they may be positioned, in particular such that their cylinders or angles may be corrected. Printing units 111 through 114 are located in a web tension-controlled region between infeed 110 and outfeed 115.

Printing units 111 through 114 each include an impression cylinder 111' through 114', against each of which a pressure roller 111" through 114" is pressed using strong pressure. Impression cylinders 111' through 114' may be driven separately and independently of one another. Associated drives 111'" through 114'" are depicted schematically. Pressure rollers 111'" through 114'" are designed such that they may rotate freely.

Infeed 110 and outfeed 115 each include two cylinders, which rotate in opposite directions and guide paper 101. Infeed 110 and outfeed 115 may also be driven separately by a drive 110'" and 115'". Infeed 110 and outfeed 115, and printing units 111 through 114 form—with paper 101 passing through them—one unit that is connected via a friction connection.

During processing, paper 101 is dried and cooled after every printing process. For this purpose, a processing device that is designed as a drying unit or dryer 121, and a processing device that is designed as a cooling unit or cooling roller 131 are situated in the section between first printing unit 111 and second printing unit 112. For this purpose, a dryer 122 and a cooling roller 132 are located in the section between second printing unit 112 and third printing unit 113, a dryer 123 and a cooling roller 133 are located in the section between third printing unit 113 and fourth printing unit 114, and a dryer 124 and a cooling roller 134 are located in the section between fourth printing unit 114 and outfeed 115.

According to the embodiment of the present invention shown, the removal of moisture in driers 121 through 124 and in cooling rollers 131-134, and the addition of moisture in printing units 111-114 may be determined, or they are known, and they may be used as a quantity for the present invention that influences the elasticity module of the material. Moreover, it is also preferably possible to account for the removal of moisture from the material comprising the material web 101 "in air" between printing units 111-114 and downstream driers 121-124, and between driers 121-124 and downstream cooling rollers 131-134, and between cooling rollers 131-134 and downstream units 112-115. An arithmetic unit 200 is provided to control the printing press, including regulating the web tension and the web register.

The addition of moisture may be determined, e.g., from the prepress stage by evaluating the print region of the printed image, and/or it may be determined at the printing unit. For this purpose, an ink quantity measuring device may be used, for example, or the position of the ink zone duct keys may be evaluated. Finally, the effect of the addition or removal of moisture on the elasticity module may be determined via one or more measurement runs.

The description below refers to FIG. 2 and describes how, in the preferred embodiment of the printing press shown, the web tension control and/or register control may be carried out with consideration for the change in the stretch behavior of the material web.

Figure 2:
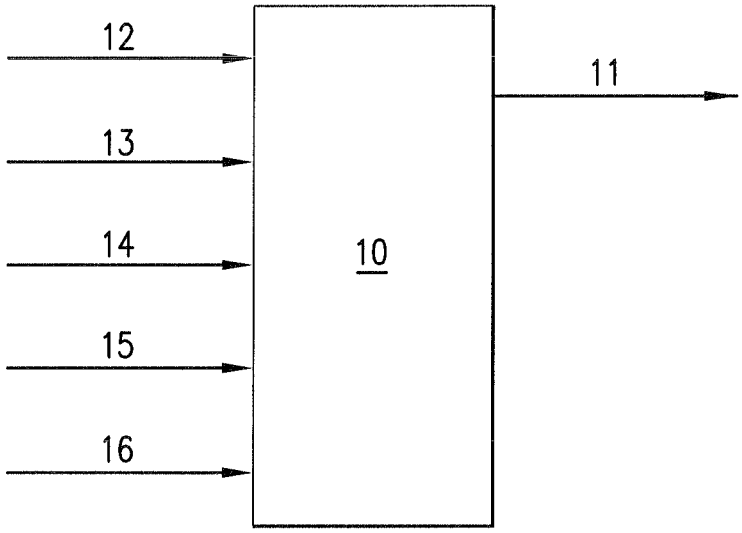
FIG. 2 is a schematic depiction of a controller design according to a preferred embodiment of the present invention.

A preferred controller design is depicted schematically in FIG. 2. A controller 10 that includes an outlet 11 for outputting the manipulated variable, and several inputs 12 through 16 is provided for this purpose. A setpoint value or the guide variable is sent to controller 10 via an input 12. Moreover, the momentary actual value or the controlled variable is sent to controller 10 via an input 13. According to the preferred embodiment of the present invention shown, controller 10 also includes inputs 14 through 16 for receiving quantities that represent the addition and/or removal of moisture.

A quantity that represents the addition of moisture to the material comprising the material web is sent to controller 10 via an input 14. This may be, in particular, a quantity of ink that is applied in a printing unit.

Moreover, a quantity that represents the removal of moisture from the material comprising the material web is sent to controller 10 via an input 15. This may be, in particular, data from the available drier, such as a dryer output or dryer temperature.

Finally, at least one material characteristic value is sent to controller 10 at an input 16. Controller 10 is therefore advantageously capable of automatically connecting the data that were obtained related to the assigned quantities to the material reaction. A controller design would also be feasible in which an input 16 for at least one material characteristic value is not provided, but rather in which the quantities are standardized using a material characteristic value before being transferred to the controller.

Controller 10 preferably includes further inputs (not depicted) for receiving further assigned quantities, provided they are not known within the controller. In particular, in order to further determine the removal of moisture, it is possible to provide the controller with the conveyance or machine speed, the distances or paths traversed between the processing devices and/or an outer temperature, etc.

Controller 10 is designed to derive the change in the elasticity module based on the data that were received and that relate to the assigned quantities. It is possible, for instance, to derive a change in the stretch behavior in the material web based on the quantity of ink that was applied. A derivation of this type may take place, in particular, based on data that were obtained in a previous measurement run. It is also possible to derive the change in the stretch behavior of the material comprising the material web during drying from the controller input data related to the drying at input 15. The derivation may take place, e.g., with consideration for the data obtained in a measurement run.

According to the embodiment of the present invention described, controller 10, which may be designed as a web-tension controller and/or a register controller, is advantageously capable of accounting for the change in the material comprising the material web during the printing, drying, and/or cooling process, thereby making it possible to attain an optimal adjustment of the controller. The soft parametrization relative to changes in the web-tension behavior, which is required in the prior art, may therefore be avoided, thereby advantageously reducing waste.

It should be pointed out here that the controller, and the inputs and outputs described above, are logical elements, the physical design and number of which may be selected as desired by a person skilled in the art. In particular, a complete, software-based design of the controller is advantageous.

It is understood that only particularly preferred embodiments of the present invention are depicted in the figures shown. Any other type of embodiment is also feasible, without leaving the scope of the present invention.

List of Reference Numerals

| | |
|---|---|
| 100 | Printing press |
| 101 | Paper |
| 110 | Infeed |
| 110''' | Drive |
| 111, 112, 113, 114 | Printing unit |
| 111', 112', 113', 114' | Impression cylinder |
| 111'', 112'', 113'', 114'' | Pressure roller |
| 111''', 112''', 113''', 114''' | Drive |
| 115 | Outfeed |
| 115''' | Drive |
| 121, 122, 123, 124 | Dryer |
| 131, 132, 133, 134 | Cooling roller |
| 10 | Controller |
| 11 | Manipulated variable |
| 12 | Controlled variable |
| 13 | Guide variable |
| 14 | Dryer variable |
| 15 | Printing unit variable |
| 16 | Material characteristic value |

What is claimed is:

1. A method for regulating a web tension and/or a register of a processing machine used to process a material web (101), comprising the following steps:

processing the material web (101) in at least one processing unit (111-114, 121-124, 131-134);

changing an elasticity modulus of a material comprising the material web (101) by adding moisture to the material comprising the material web, by removing moisture from the material comprising the material web (101), or by both adding and removing moisture from the material comprising the material web;

providing a controller (10) for register regulation, web tension regulation, or both, taking into account moisture control of the material web wherein said controller (10) includes at least one input for receiving quantities that represent the addition of moisture, the removal of moisture or both, and further includes an outlet for outputting different control parameters based on different quantities of moisture;

adjusting the controller based on the quantities that represent the amount of moisture added to the material comprising the material web (101), the amount of moisture removed from the material comprising the material web (101), or both the amount of moisture added and the amount of moisture removed from the material comprising the material web (101), wherein the processing machine is a printing press (100), and a quantity of fluid to be applied by a printing unit (111-114) is used as the quantity that represents the addition of moisture to the material of the material web (101), and wherein the processing machine is a printing press (100), and wherein the variable that represents removal of moisture from the material comprising the material web (101) is selected from the group consisting of a temperature, heat output or radiation output of a drying unit (121-124), a drying time, a temperature or cooling output of a cooling unit (131-134), and a cooling time.

2. The method as recited in claim 1, further comprising taking into account the quantity that represents the addition of moisture to the material comprising the material web (101) and/or the loss of moisture from the material comprising the material web (101) as a control parameter, an input variable, and/or pilot control value of actual values and/or setpoint values.

3. The method as recited in claim 1, further comprising determining at least one feed-forward value based on a measurement run by considering the web tension and/or register in terms of regulation.

4. The method as recited in claim 1, further comprising adapting at least one feed-forward value to the process.

5. The method as recited in claim 4, wherein the processing machine (100) includes at least one damping unit (111-114), a drying unit (121-124), and/or a cooling unit (131-134), an adaptation being carried out based on setpoint quantities and/or actual quantities of the at least one damping unit (111-114), drying unit (121-124), and/or cooling unit (131-134).

6. The method as recited in claim 5, further comprising calculating a model of physical details of material characteristic values as a function of adaptation quantities.

7. The method as recited in claim 1, wherein the processing machine is a printing press (100), and at least one pilot control value and/or at least one initialization value is obtained from prepress data.

8. The method as recited in claim 1, wherein an automatic controller setting is provided based on the overall system behavior that is observed.

* * * * *